US007104873B1

(12) United States Patent
Borinato et al.

(10) Patent No.: US 7,104,873 B1
(45) Date of Patent: Sep. 12, 2006

(54) ANTI-VIBRATION ARRANGEMENT

(75) Inventors: Gianni Borinato, Schio (IT); Paolo Andriolo, Vicenza (IT)

(73) Assignee: Positec Power Tools (Suzhou) Co., (CN)

( * ) Notice: Subject to any disclaimer, the term of this patent is extended or adjusted under 35 U.S.C. 154(b) by 0 days.

(21) Appl. No.: 11/151,050

(22) Filed: Jun. 13, 2005

(30) Foreign Application Priority Data

Apr. 18, 2005 (EP) ..... 05252417.0

(51) Int. Cl.
*B24B 7/00* (2006.01)

(52) U.S. Cl. ..... 451/159; 451/163; 451/270; 451/357; 451/121

(58) Field of Classification Search ..... 451/357, 451/163, 270, 121, 294, 461, 159
See application file for complete search history.

(56) References Cited

U.S. PATENT DOCUMENTS

| | | | | |
|---|---|---|---|---|
| 2,673,425 | A * | 3/1954 | Karnell | 451/548 |
| 2,759,305 | A | 8/1956 | Helbig | |
| 6,179,695 | B1 * | 1/2001 | Takahashi et al. | 451/287 |
| 6,206,771 | B1 * | 3/2001 | Lehman | 451/357 |
| 6,336,849 | B1 * | 1/2002 | Konnemann | 451/259 |
| 6,386,956 | B1 * | 5/2002 | Sato et al. | 451/57 |
| 6,905,398 | B1 * | 6/2005 | Jeong | 451/57 |
| 6,913,528 | B1 * | 7/2005 | Schulz et al. | 451/285 |

FOREIGN PATENT DOCUMENTS

| | | |
|---|---|---|
| EP | 1300218 A1 | 4/2003 |
| JP | 2002233941 | 8/2002 |
| WO | WO 2004/085114 A1 | 10/2004 |

* cited by examiner

*Primary Examiner*—George Nguyen
(74) *Attorney, Agent, or Firm*—Fulwider Patton LLP

(57) ABSTRACT

The present invention relates to an anti-vibration arrangement (10) for a power sander (1) which comprises a housing (2), a motor (4) arranged in the housing (2), a rotary drive shaft (11), a first outer or ring-shaped pad surface (16) for attaching a first sanding paper (8) and a second inner or circular pad surface (22) for attaching a second sanding paper (9). The anti-vibration arrangement (10) serves to transfer energy from the motor (4) to the pads (16, 22) with out-of-phase motions to dynamically compensate for inertial and friction forces. For this purpose, twin cams (18*a*, 18*b*) are fixed on the rotary drive shaft (11). The cams (18*a*, 18*b*) rotate the central axes (15, 21) of the pads (16, 22) about the rotary drive shaft axis (12) with a phase differential of typically 180°. Vibration which would otherwise be transmitted to the rotary drive shaft (11) and from there to the operator of the machine (1) are drastically reduced irrespective of whether or not the operator increases the applied force (1) in order to increase the sanding depth or to speed up the sanding operation.

33 Claims, 11 Drawing Sheets

ANTI-VIBRATION ARRANGEMENT

REFERENCES TO RELATED APPLICATIONS

This is a non-provisional application claiming priority to European Application Number 05252417.0, entitled Anti-Vibration Device, filed 18 Apr. 2005, which is hereby incorporated by reference in its entirety.

FIELD OF THE INVENTION

The present invention relates to an anti-vibration arrangement for an eccentrically rotary and oscillatory tool (eg an abrasive power tool) such as an orbital sander or polisher, to a power tool incorporating the anti-vibration arrangement and to a method for abrading a work piece.

BACKGROUND OF THE INVENTION

Orbital power tools such as sanders and polishers generally include a pad that is normally adapted to support an abrasive element such as sanding paper. The pad is coupled by a transmission means to a motor arranged in a housing. The transmission means can incorporate a cam rotationally driven by the rotary drive shaft. The cam is housed in a circular aperture that is positioned in the centre of the pad. The rotation of the cam drives every point of the pad in a circular orbit whose radius equals the eccentricity of the cam ie the distance between the rotary axis of the rotary drive shaft and the centre of the circular aperture which is substantially coincident with the centre of the pad. By allowing the pad to rotate around the centre of the circular orbit, it describes a combined rotary/orbital motion referred to as a "random orbit".

The orbital motion can be envisaged as a linear motion (or stroke) in which the pad mass is accelerated in a certain direction. The acceleration produces a reaction force directed in the opposite direction. This reaction force manifests itself as an unwanted vibration which is transmitted to the housing and ultimately to the operator's hand and arm. The amplitude of this unwanted vibration depends on the diameter of the orbit and on the ratio between the mass of the pad and the mass of the tool.

In order to keep vibrations beneath an acceptable level, conventional tools are designed in such a way that the working surface of the pad and the orbital diameter are relatively small. However, these limitations reduce the efficiency of the machine. In order to compensate for these limitations in efficiency, operators frequently apply a certain pressure or load to the tool in order to increase the friction on the work piece with the result that vibrations are amplified. In order to counteract the resulting increase in vibrations, the operator tends to grasp and apply the tool with even more force to the work piece. By doing this, the effective mass of the machine is increased and the vibrations are absorbed by the operator's hand and arm with often severe consequences for the operator's health. For example, even low usage operators may experience numbness and tingling in their fingers, hand and arm within a few minutes of operation and this may be lead to an unpleasant loss of feeling and control in the fingers that can last for hours after use has ceased. If use is prolonged for hours, a full recovery can take several days. The consequences for professional workers can be even more severe and long term may lead to retirement and high social costs. On the other hand, adopting strict guidelines relating to vibration threshold values would have a severe impact on productivity and costs.

Operators of power tools tend to apply a certain load to the tool so that the speed of the work is increased. The increase in the working efficiency that is achieved by the increased load is due exclusively to the increase in friction between the pad and the work piece. On the other hand, the increased load unbalances the tool and increases the unwanted vibrations. The diameter of the unwanted vibrations is subtracted from the orbital diameter of the pad. In practice, the effective working orbital diameter is the result of the theoretical orbit diameter less that of the unwanted vibrations.

An arrangement for overcoming the above-mentioned drawbacks adopts one or more counterbalances (eg eccentric masses or counterweights) that move in a direction opposite to that of the pad to counterbalance the vibrations. Examples of this kind of arrangement are illustrated in U.S. Pat. No. 4,660,329, U.S. Pat. No. 4,729,194, U.S. Pat. No. 5,888,128, U.S. Pat. No. 6,244,943, US-A-6206771, U.S. 2001/0003087, DE-A-3922522, EP-A-303955, EP-A-0455618, WO-A-98/01733 and WO-A-02/068151. In general, this type of arrangement works satisfactorily when the pad is not touching the work piece but displays major limitations in normal use. As soon as the pad is placed on the work piece, the load effectively modifies the mass of the pad and the ratio between the mass of the pad and the mass of the counterbalance is altered. As a result, the counterbalance fails to eliminate the vibrations induced by the heightened effective mass of the pad. The higher the load, the greater the system imbalance and the higher the level of unwanted vibrations. With a load tending to infinity, the pad will be at a standstill and the tool will vibrate with an amplitude equal to the radius of the orbit of the pad.

Another arrangement for overcoming the above-mentioned drawbacks uses elastic materials as an interface between the tool and the operator's hands for dampening vibrations. The kinetic energy of the vibrations is converted into thermal energy. Examples of this type of arrangement are illustrated in U.S. Pat. No. 4,905,772, U.S. Pat. No. 5,453,577, U.S. Pat. No. 5,347,764, U.S. 2001/0011856 A1, WO-A-03/049902. However, by interposing an elastic element between the housing and the operator's hand, the tool is free to vibrate with greater amplitude than if it was firmly held by the operator. In practice, the operator instinctively feels the decreased efficiency of the machine and tends to grasp it with increased force in an attempt to restore efficiency. By doing this, the effeciency of the elastic element is minimized so that vibrations are transmitted to the operator's hand and arm. Moreover, the increased muscular force reduces the human body's natural capability to dampen vibrations.

OBJECT OF THE INVENTION

An object of the present invention is to overcome certain of the above-described drawbacks by exploiting two or more pads exbiting out-of-phase orbital motion.

SUMMARY OF THE INVENTION

Thus viewed from one aspect the present invention provides an anti-vibration arrangement for an eccentrically rotatable and oscillatory tool (eg a motor-driven abrasive tool), the arrangement comprising:

- a first pad having a first external pad surface for fitting a first abrasive element;
- a second pad having a second external pad surface for fitting a second abrasive element, wherein the first external pad surface and the second external pad surface are substantially coplanar; and transmission means driveable by a rotary drive shaft of the motor, wherein the transmission means is adapted to transmit drive to the first pad and to the second pad to cause the first external pad surface and the second external pad surface to orbit out-of-phase about a first orbital axis and a second orbital axis respectively.

The anti-vibration arrangement dynamically compensates for inertial and frictional forces and reduces or eliminates vibrations that are otherwise transmitted to the rotary shaft. Thus at relatively low cost, the anti-vibration arrangement significantly reduces the risks to the operator's health. The arrangement is easy to use and convenient to maintain and even when the load is unequally shared by the abrasive elements, the residual vibrations are lower than in a conventional machine provided (for example) with a counterbalance mechanism.

The motor can be electric or pneumatic.

Preferably the first pad has essentially the same mass as the second pad.

Preferably the first external pad surface has essentially the same area as the second external pad surface.

Preferably the centre of gravity of the first pad and the centre of gravity of the second pad are aligned along a straight line intersecting the rotary axis.

Preferably the second external pad surface is arranged substantially peripherally and eccentrically with regard to the first external pad surface.

Preferably the second external pad surface is substantially circular. Preferably the first external pad surface is substantially annular. The second external pad surface may be confined within the first external pad surface.

Preferably the first pad is substantially bell-shaped and comprises a conical main body terminating at an apical end in an annular lip and terminating at a non-apical end opposite to the apical end in a radial collar, the radial collar defining the first external pad surface.

Preferably the second pad comprises a cylindrical main body capped by a circular plate defining the second external pad surface.

Preferably the first pad further comprises at least one dust vent.

The first orbital axis and the second orbital axis may be coincident or non-coincident. The first orbital axis and/or the second orbital axis may coincide with the rotary axis of the rotary drive shaft. Preferably the first orbital axis and the second orbital axis are common to the rotary axis of the rotary drive shaft.

Preferably the central axis of the first external pad surface and the central axis of the second external pad surface are arranged parallel to the rotary axis substantially in a common plane therewith. Particularly preferably the central axis of the first external pad surface and the central axis of the second external pad surface are equidistant from the rotary axis. This advantageously makes construction simple but there may be occasions where a deviation from this condition is desirable.

Preferably the transmission means comprises:

a monolithic drive shaft assembly mountable on the rotary drive shaft and having a first cam and a second cam for transmitting drive to the first external pad surface and the second external pad surface respectively.

The cams may be coupled directly or indirectly to the rotary drive shaft. The cams may be any suitable shape (eg cylindrical or elliptical).

Particularly preferably the first cam and the second cam are non-coaxial. Partciuarly preferably the monolithic drive shaft assembly is provided with a central aperture for mounting on the rotary drive shaft, wherein the first cam and the second cam are substantially identical and are longitudinally and angularly displaced. Preferably the first cam and the second cam are angularly displaced by approximately 180°.

In a particularly preferred embodiment, the first cam and the second cam are each substantially cylindrical and wherein the eccentricity of the first cam and the second cam with respect to the rotary axis equals the orbital diameter.

Preferably the outer diameter of the second external pad surface is slightly smaller than the inner diameter of the first external pad surface so that a minimum gap is maintained between the second external pad surface and the first external pad surface. Particularly preferably the gap defines a passage for emitting debris from a work piece during use. The gap can be connected to suction means such as a fan for removing debris and dust from the work piece. This removes the need for apertures that are normally included in conventional machines.

Preferably the transmission means comprises: a first bearing mounted on or in the first pad; and a second bearing mounted on or in the second pad. Particularly preferably the first bearing is mounted on the first cam and the second bearing is mounted on the second cam.

Preferably the first external pad surface and the second external pad surface are substantially rectangular or square.

The anti-vibration arrangement of the invention may further comprise any number of additional pads (eg third and fourth pads). Typically the central axes of the external pad surfaces of the pads are equidistant from the rotary axis. The total number of pads can be driven by a suitable number of drive shaft assemblies with a suitable disposition (eg a suitable number of cams).

In a preferred embodiment, the arrangement comprises four pads with external pad surfaces having individual orbital axes, wherein neighboring pads are adapted to orbit in opposite directions. The individual orbital axes may be non-coincident with the rotary axis. Particularly preferably the four pads are disposed in a square configuration.

Preferably the first external pad surface has a first predetermined orientation and the second external pad surface has a second predetermined orientation, wherein the transmission means is adapted to transmit drive to the first external pad surface and the second external pad surface in a manner such that the first and second predetermined orientations are maintained.

Viewed from a further aspect the present invention provides a method for abrading a work piece comprising:

causing a first pad with a first external pad surface having a first predetermined orientation and a second pad with a second external pad surface having a second predetermined orientation to be driven such that the first external pad surface orbits about a first orbital axis and the second external pad surface orbits about a second orbital axis with a phase differential to compensate for vibrations.

Preferably the first orbital axis and the second orbital axis coincide.

Preferably the first predetermined orientation and the second predetermined orientation are maintained during orbit.

Preferably the first external pad surface is substantially annular and the second external pad surface is substantially circular and wherein the second external pad surface is arranged within the first external pad surface and the first external pad surface and the second external pad surface are angularly offset by approximately 180°.

Of independent patentable significance is a portable tool (eg a sander or a polisher) comprising an anti-vibration arrangement as hereinbefore defined which allows the user to accomplish coarse and/or fine surface sanding work on any material with high efficiency and productivity and with a substantial reduction in vibrations irrespective of the the load applied by the user.

Viewed from a yet further aspect the present invention provides an eccentrically rotatable and oscillatory tool (eg a portable abrasive tool) comprising:

a housing;

a handle mounted on or integral with the housing;

an electric motor supported in the housing, wherein the electric motor has a rotary drive shaft with a longitudinal rotary axis; and transmission means driveable by a rotary drive shaft of the motor for transmitting drive to a first pad and to a second pad to cause a first external pad surface of the first pad and a second external pad surface of the second pad to orbit out-of-phase about a first orbital axis and a second orbital axis respectively.

Preferably the tool comprises: an anti-vibration arrangement as defined hereinbefore, wherein the transmission means couples the rotary drive shaft to the first pad and to the second pad.

The functionality of this tool advantageously does not depend on the rotation speed, the weight, the type of abrasive surface, the radius of rotation of the pads or the load conditions.

Although the absence of a conventional counterweight advantageously increases the useful energy available for abrasion, a counterweight may be added. The counterweight may be any convenient shape.

Preferably the tool further comprises:

a counterweight associated with the rotary drive shaft, wherein the centre of gravity of the counterweight is located outside the rotary axis.

Preferably the tool further comprises:

a cooling fan mounted radially on the rotary drive shaft; and a counterweight disposed on the cooling fan, wherein the centre of gravity of the counterweight and the cooling fan is located outside the rotary axis.

Preferably the tool further comprises:

an air and dust vent connected to or integral with the housing for connecting a fan.

The tool may be a rotary sander, random orbital sander or finishing sander. For a finishing sander, connection pieces made of a resilient material may be deployed to restrain the tool to regular orbital motion. In a finishing sander the pads maintain their predetermined orientations.

Preferably the tool further comprises:

a first resilient connection piece fixed between the first pad and the housing and a second resilient connection piece fixed between the second pad and the housing.

Preferably the tool further comprises:

at least one brake for reducing the rotational speed of at least one of the first and second pads at least when no load is applied to at least one of the first and second pads.

The brake (or brakes) permit high rotational speeds to be avoided especially when no load is applied to the pads.

Viewed from a yet still further aspect the present invention provides a kit comprising a substantially annular sanding paper attachable to a first pad defined hereinbefore and a substantially circular sanding paper attachable to a second pad as hereinbefore defined.

DESCRIPTION OF PREFERRED EMBODIMENTS

Figure 1:
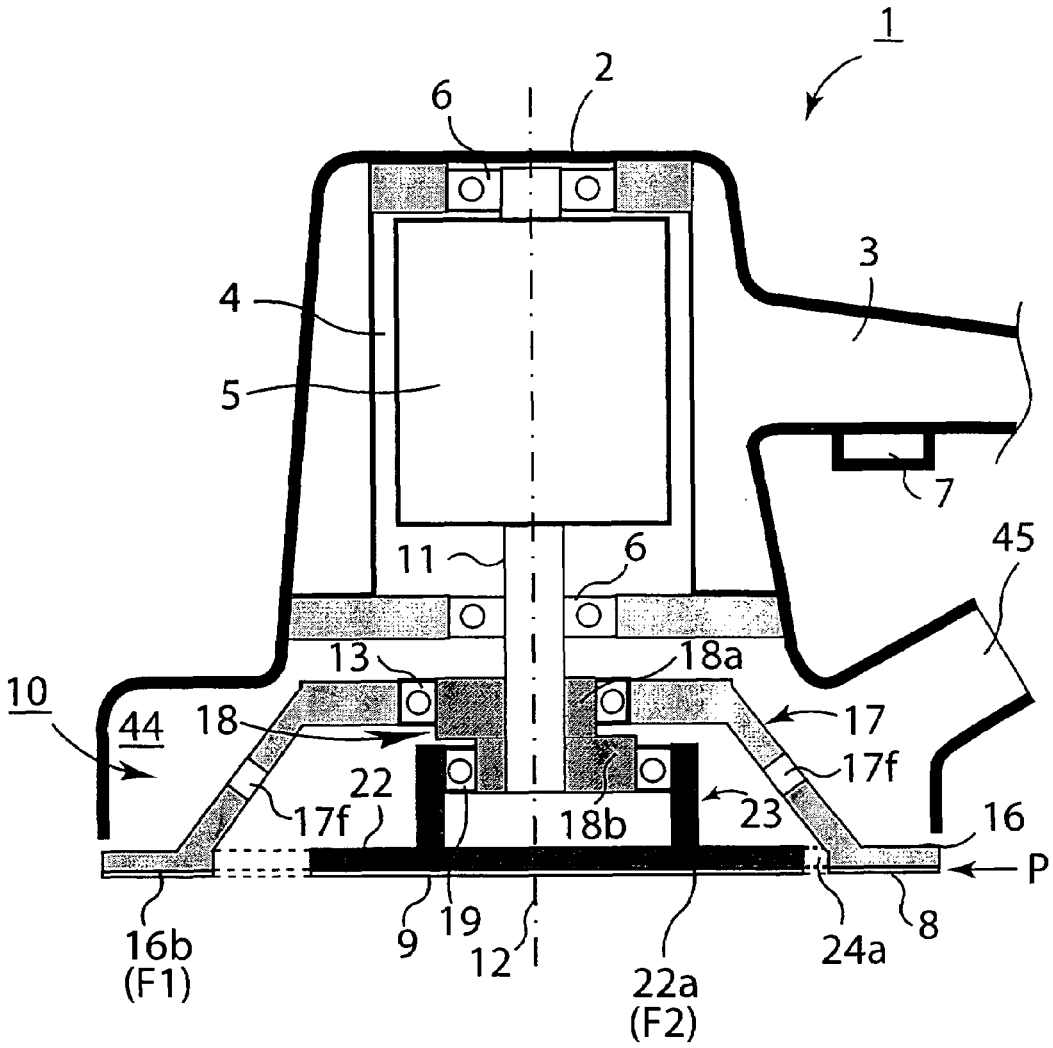
FIG. 1 is a partial side view of a first rotary sander incorporating a first embodiment of the anti-vibration arrangement of the invention.
Figure 2:
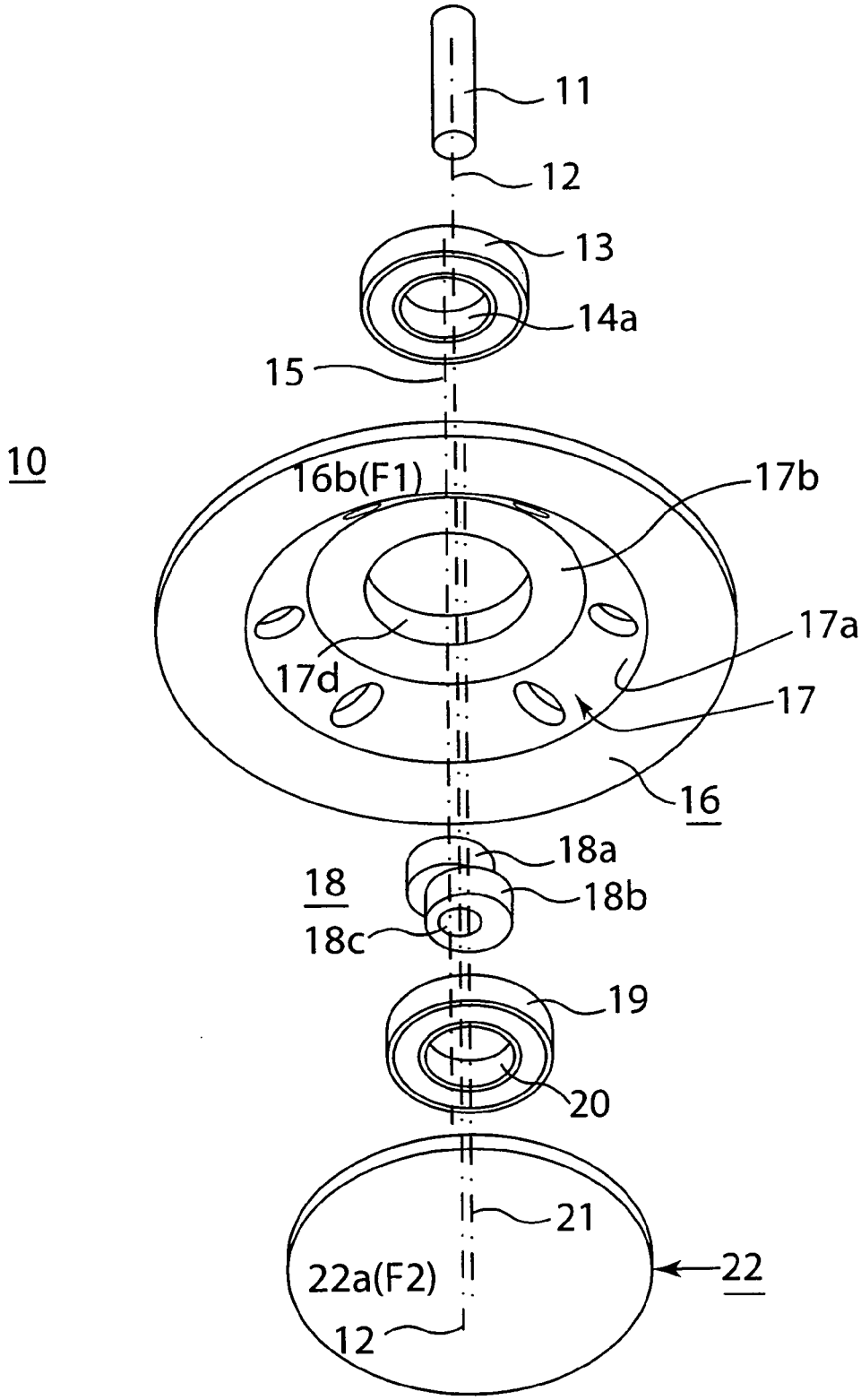
FIG. 2 is an exploded perspective view of the anti-vibration arrangement of FIG. 1.

FIG. 1 illustrates a rotary sander 1 incorporating a first embodiment of an anti-vibration arrangement 10 according to the present invention. The rotary sander 1 generally includes a housing 2 that has a handle or grip 3 and an internal volume 4 for housing an electric motor 5 with a variable speed of 2000 to 12000 rpm. The housing 2 is provided with an exhaust tube 45 beneath the handle 3 for exhausting air and dust from the interior 44. The electric motor 5 has a rotary drive shaft 11 with a longitudinal rotary axis 12 which is supported at the upper end of the housing 2 by ball, cylinder or oil bearings 6. A power switch 7 is positioned on the handle 3 and the rotary sander 1 is connected to mains power, a rechargeable battery or a compressed air tank which is not represented in FIG. 1. The anti-vibration arrangement 10 couples the rotary drive shaft 11 to abrasive elements (such as abrasive layers or sanding papers) for abrading a work piece (not shown) as described below.

Figure 3:
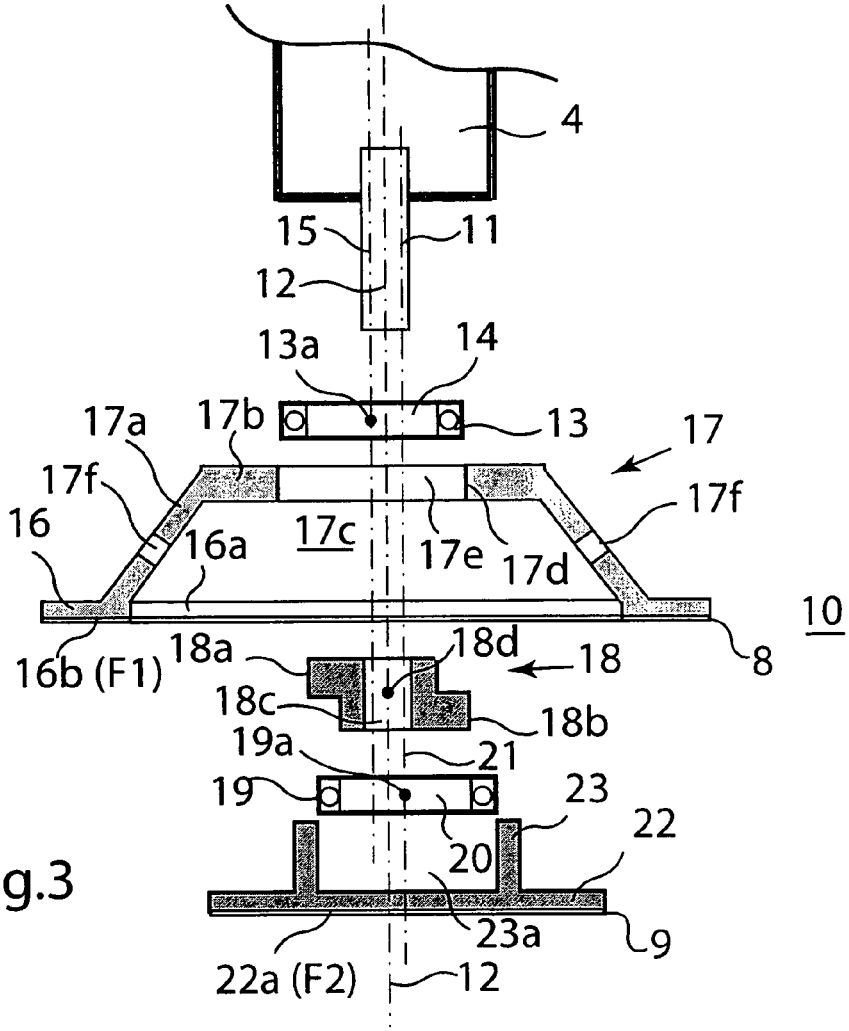
FIG. 3 is an exploded cross-sectional view of the anti-vibration arrangement of FIG. 2.
Figure 4:
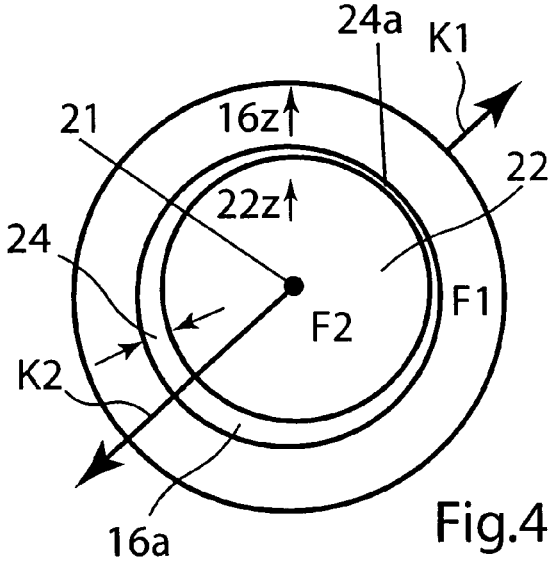
FIG. 4 is a view of the anti-vibration arrangement of FIGS. 1–3 in reduced scale from below.
Figure 5:
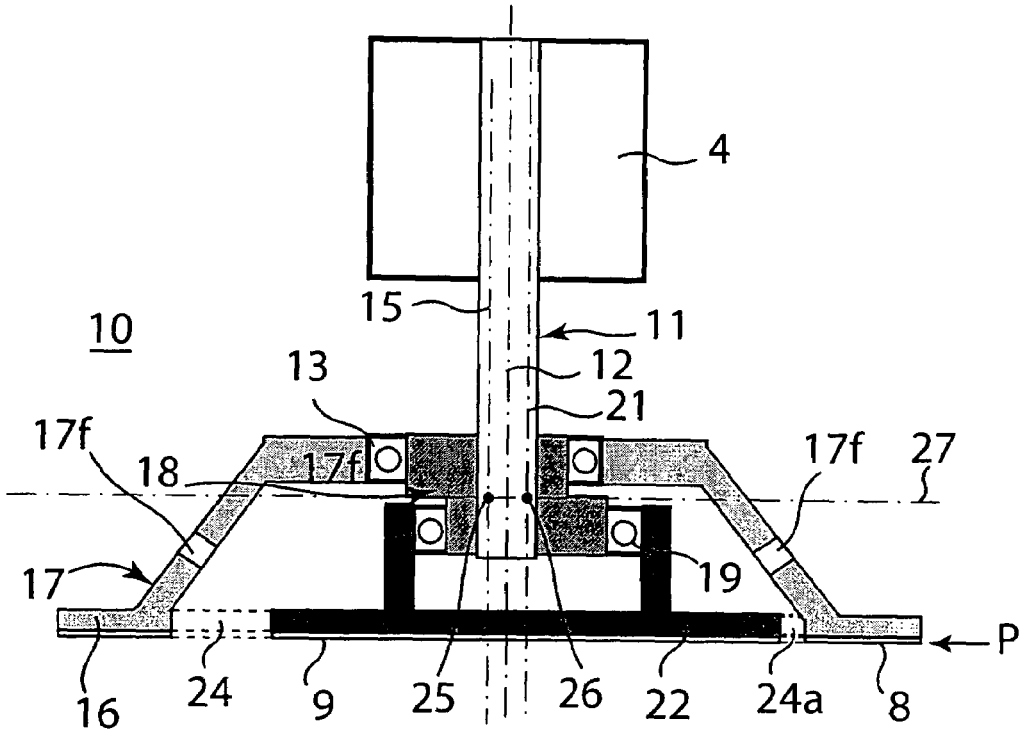
FIG. 5 is an assembled cross-sectional view of the anti-vibration arrangement of FIG. 3.
Figure 6:
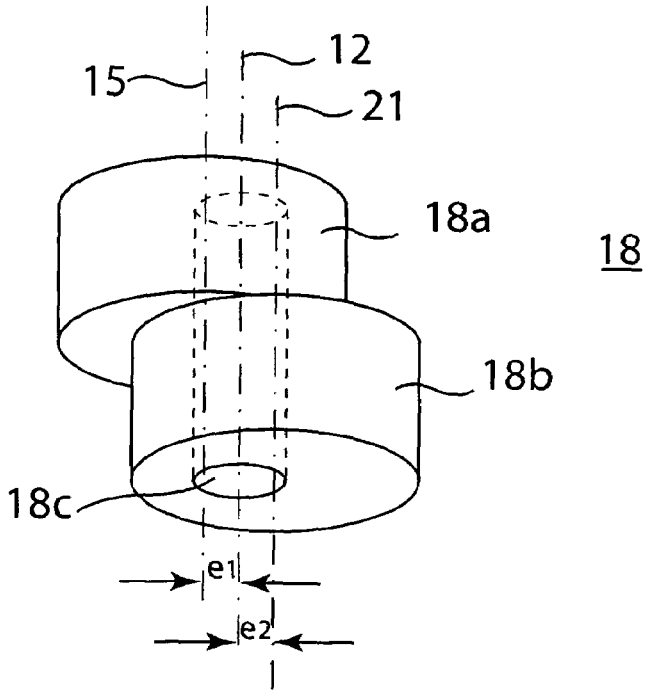
FIG. 6 is a perspective view of the drive shaft assembly of the anti-vibration arrangement of FIGS. 1–5.

Referring to FIGS. 2–6, the anti-vibration arrangement 10 comprises a bell-shaped first pad 17 having a substantially conical main body 17*a* enclosing a central lower volume 17*c* and terminating at an apical end in an annular lip 17*b* bounding an aperture 17*e*. At a non-apical end (opposite the apical end), the conical main body 17*a* terminates in a radial collar 16 bounding an aperture 16*a* and having a first external pad surface 16*b* for fitting to a substantially planar annular abrasive element 8. The area of the first external pad surface 16*b* is designated F1. As can be seen in FIGS. 1, 3 and 5, air and dust vents 17*f* are provided in the conical main body 17*a*. When a fan (not shown) is connected to the exhaust tube 45, debris from the work piece can be exhausted from the internal volume 4 through the vents 17*f*.

The anti-vibration arrangement 10 further comprises a second pad 23 having a cylindrical main body 23*a* capped by a circular plate 22 with a second external pad surface 22*a* for fitting to a substantially planar circular abrasive element 9. The circular plate 22 is accommodated in the aperture 16*a* of the radial collar 16. The area of the second external pad surface 22*a* is designated F2.

The anti-vibration arrangement 10 is adapted to reduce the amplitude of vibrations that are generated by the reaction of the first and second external pad surfaces 16*b*, 22*a* on the work piece. For this purpose, the anti-vibration arrangement 10 is arranged so that the first and second external pad surfaces 16*b*, 22*a* are disposed distinctly and separately from each other. The pads 17 and 23 have substantially identical mass. The first and second external pad surfaces 16*b*, 22*a* have substantially identical surface areas F1 and F2 and are located substantially in the same plane P (see FIGS. 1 and 5).

The anti-vibration arrangement 10 is adapted to provide orbital motion to the first and second external pad surfaces 16*b*, 22*a* in different phases. Through their out-of-phase motion, the first and second external pad surfaces 16*b*, 22*a* dynamically compensate for inertial and frictional forces and thus reduce the vibrations transmitted back to the rotary drive shaft 11. For this purpose, the anti-vibration arrangement 10 further comprises a monolithic drive shaft assembly 18 having first (upper) and second (lower) substantially cylindrical cams 18*a*, 18*b*. The drive shaft assembly 18 is provided with a central aperture 18*c* coincident with the rotary axis 12 for a firm connection to the rotary drive shaft 11 so that the cams 18*a*, 18*b* rotate at the same speed as the rotary drive shaft 11. The cylindrical cams 18*a*, 18*b* are substantially identical to each other but they are longitudinally displaced (non-coaxial) and angularly offset relative to the plane of the housing by about 180° to drive respectively the first and second pads 17, 23 in an out-of-phase eccentric manner.

A first bearing 13 is firmly received in the aperture 17*e* of the annular lip 17*b* and is mounted on the cam 18*a*. A second bearing 19 is firmly received in the cylindrical main body 23*a* and is mounted on the cam 18*b*. The first bearing 13 and the second bearing 19 may be ball bearings or cylinder bearings. The centre of the first bearing 13 is denoted as 13*a*, its central aperture as 14 and its central axis as 15. The centre of the second bearing 19 is denoted as 19*a*, its central aperture as 20 and its central axis as 21. The outer surface of the first cam 18*a* is received in the central aperture 14 of the first bearing 13 (and fixed therein) and the second cam 18*b* is received in the central aperture 20 of the second bearing 19 (and fixed therein). The rotation of the rotary drive shaft 11 is transferred to the first and second cams 18*a*, 18*b* and from there slidingly via the bearings 13 and 19 to the first and second pad 17 and 23 respectively (ie to the first and second external pad surfaces 16*b*, 22*a* respectively). It will be noted from FIGS. 1–7 that the only connection between the first and second pads 17, 23 and the housing 2 are the two ball bearings 13 and 19 respectively.

The central axes 15, 21 are arranged parallel to the rotary axis 12 substantially in a common plane therewith. The central axis 15 coincides with the central axis of the first external pad surface 16*a* and the central axis 21 coincides with the central axis of the second external pad surface 22*b*. The eccentricities e1, e2 of the cams 18*a*, 18*b* with respect to the rotary axis 12 (ie the distances between the axes 15/12 and 21/12 respectively) are identical (ie e1=e2) and equate to the diameter of the desired orbit.

The anti-vibration arrangement is such that the centre of gravity 25 of the first pad 17 and the centre of gravity 26 of the second pad 23 are aligned along a straight line 27 passing through the rotary axis 12 (see FIG. 5). During use the central axis 15 orbits about the rotary axis 12. Also during use the central axis 21 orbits about the rotary axis 12 with a phase differential of 180° with respect to the orbit of the central axis 15. Consequently, pads 17 and 23 describe eccentric orbits with a phase differential of 180° relative to each other.

As can been seen in FIGS. 4 and 5, the diameter of the circular plate 22 is slightly smaller than the inner diameter of the radial collar 16 so that a gap 24 is maintained between the radial collar 16 and the circular plate 22 during rotation with a predetermined minimum gap 24*a*. The gap 24 between the radial collar 16 and the circular plate 22 defines a passage for debris and dust from the work piece.

During use, forces K1, K2 are generated and associated with the radial collar 16 and the circular plate 22 respectively (see FIG. 4). These forces K1, K2 act in opposite directions (due to the phase differential of 180°) and therefore substantially eliminate vibrations which would otherwise be transferred back to the housing 2.

Figure 7:
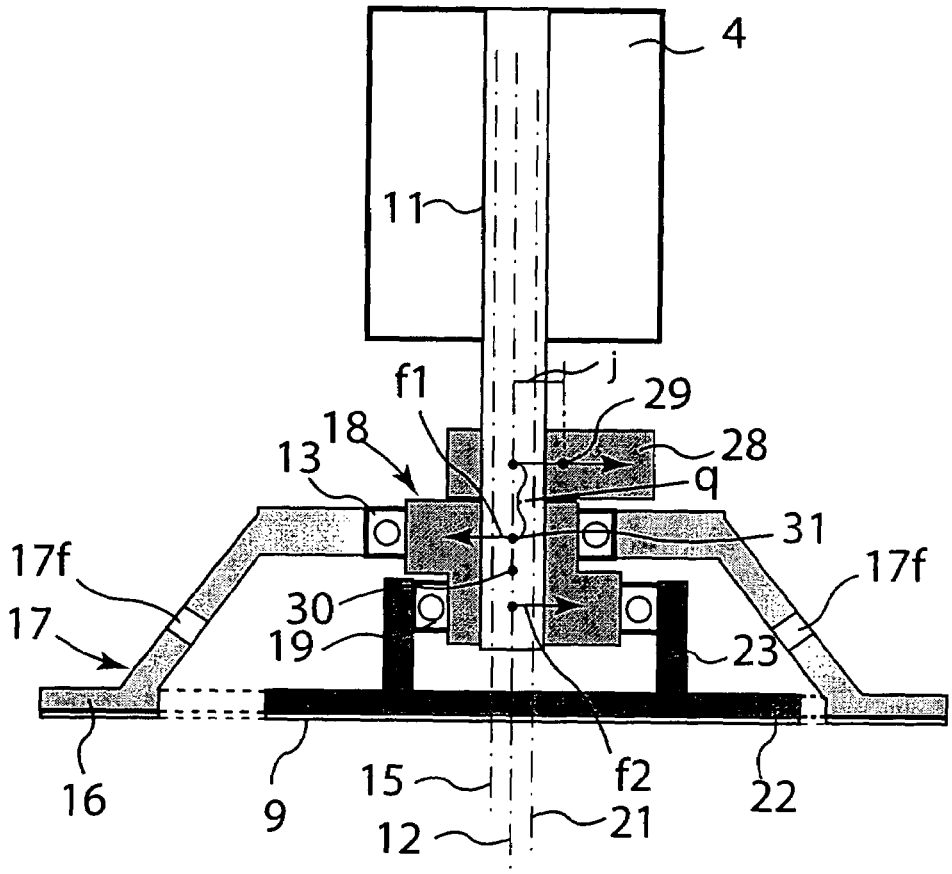
FIG. 7 is an assembled cross-sectional view of a third embodiment of the anti-vibration arrangement of the invention.
Figure 14:
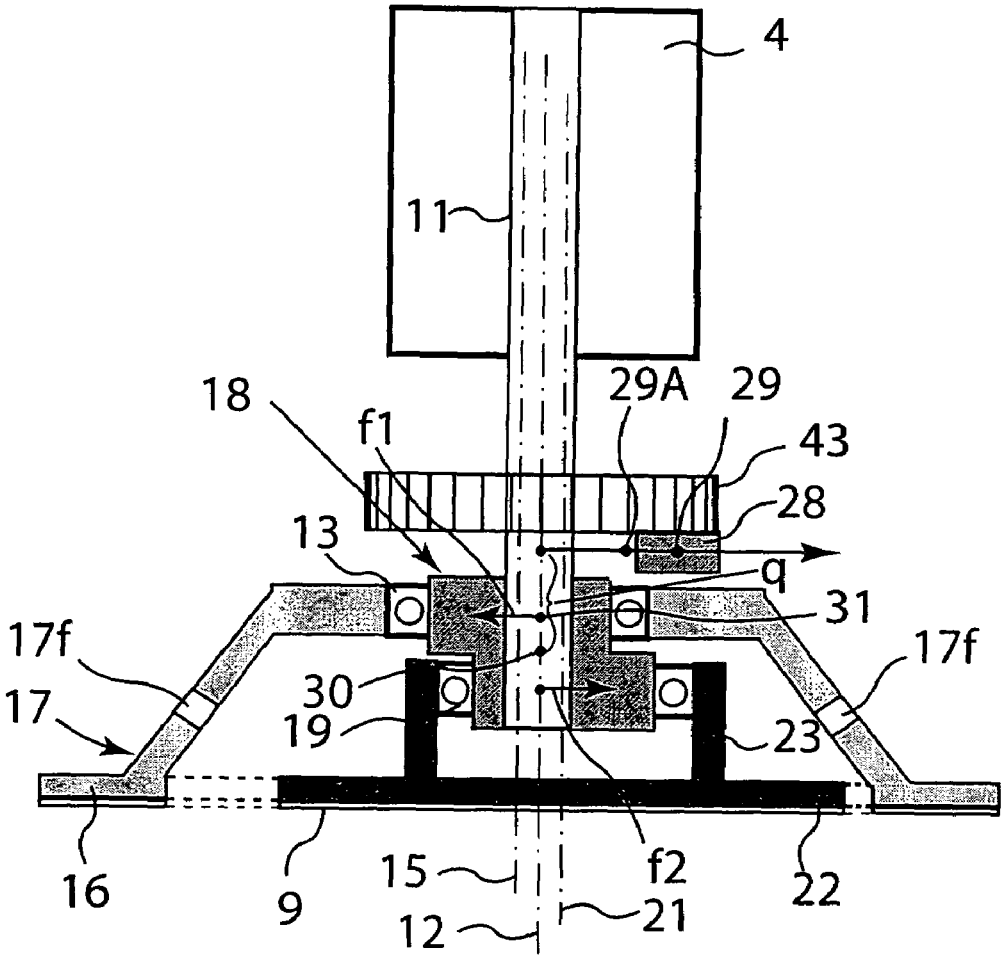
FIG. 14 is an assembled cross-sectional view of a fourth embodiment of the anti-vibration arrangement of the invention.

As illustrated in FIG. 7, during operation of the rotary sander 1 a small torque may be generated by forces f1, f2 around a point 30 which is the centre of gravity of the arrangement (ie of the first and second pads 17, 23, the bearings 13, 19 and the drive shaft assembly 18). These forces f1, f2 are generated by centrifugal effects and may lead to vibrations. In order to eliminate the torque, a cylindrical counterweight 28 is associated with the rotary drive shaft 11. The counterweight 28 may be firmly mounted directly on the rotary drive shaft 11 (as in FIG. 7) or connected to the drive shaft assembly 18 or it may be mounted on the lower outer side of a cooling fan 43 (as shown in FIG. 14) connected to the rotary drive shaft 11 for cooling the motor 4. The centre of gravity 29 of the counterweight 28 is located outside the rotary axis 12 with an eccentricity denoted j in FIG. 7 and the total centre of gravity is positioned at point 31. The mass of the first pad 17 equals the mass of the second pad 23 plus the mass of the counterweight 28 because for balancing purposes not only the mass of the counterweight 28 is essential but also its distance q from point 31. In a similar manner in FIG. 14, the centre of gravity 29A of the counterweight 28 and of the cooling fan 43 is located outside the rotary axis 12.

Figure 8:
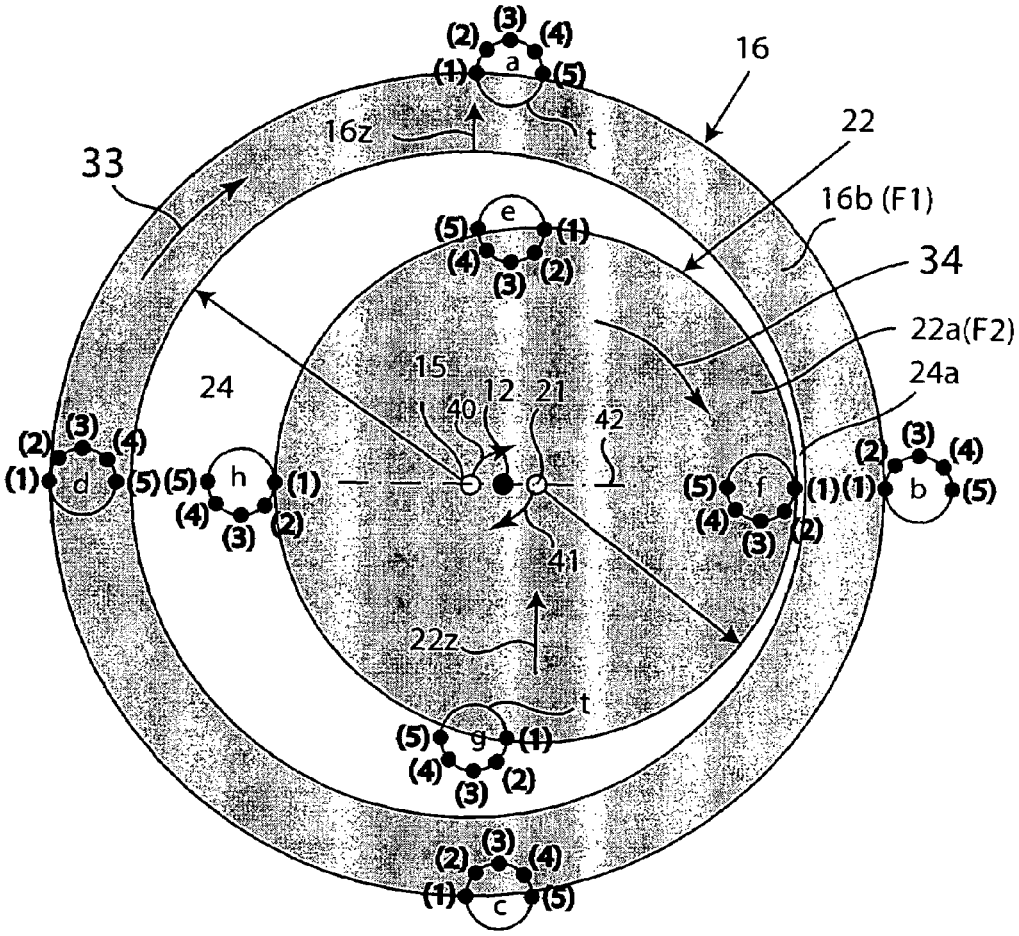
FIG. 8 is a schematic view of the path of eight small sanding particles during use of the anti-vibration arrangement of FIG. 1.
Figure 9:
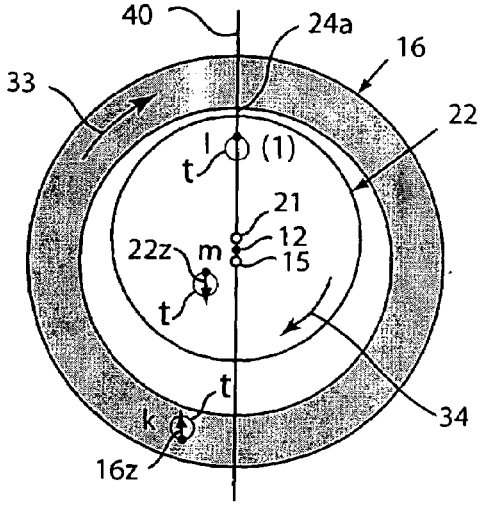
FIGS. 9–12 illustrate schematically the path of another four small sanding particles during use of the anti-vibration arrangement of FIG. 1.
Figure 10:
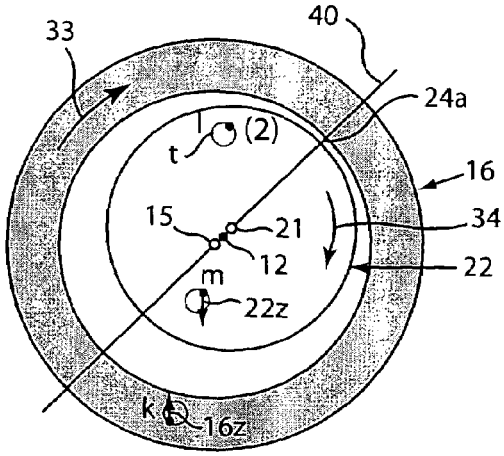
Figure 11:
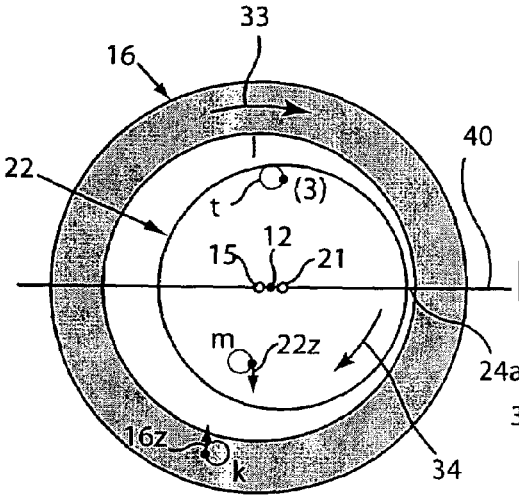
Figure 12:
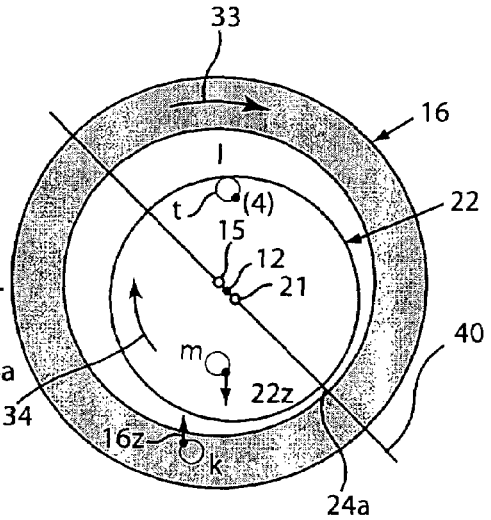

In FIG. 8, the radial collar 16 is illustrated from below to demonstrate the function of the anti-vibration arrangement 10. The first and second external pad surfaces 16*b*, 22*a* are located in the same plane P and their surface areas F1, F2 are equal. During use, the central axis 15 of the radial collar 16 describes a small circle 40 around the rotary axis 12 of the rotary drive shaft 11 and the central axis 21 of the circular plate 22 with a phase differential of 180° also describes a small circle 41 around the rotary axis 12. For illustrative purposes, a connection line 42 connects the axes 15, 12 and 21. The distance between the axes 12 and 15 equals the distance between the axes 12 and 21.

Figure 15:
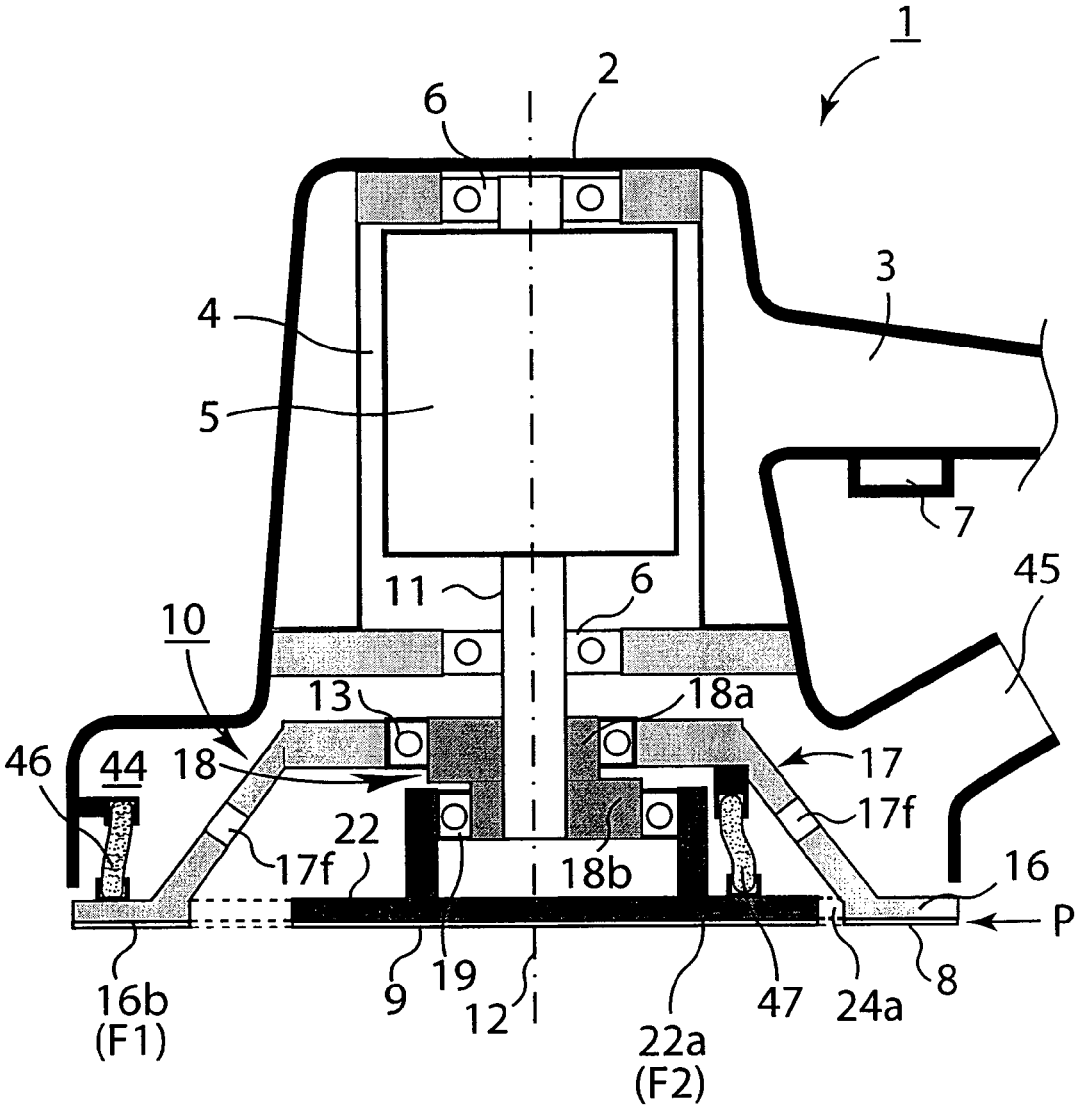
FIG. 15 is a partial side view of a finishing sander incorporating the first embodiment of the anti-vibration arrangement of the invention.

For illustrative purposes with reference to FIG. 8, an arrow 16*z* may be assumed to be fixed on the first external pad surface 16*b* of the radial collar 16. It indicates a predetermined direction or orientation of the radial collar 16 with regard to the rotary sander 1. For example it is directed from the front side of the rotary sander 1 to the back side. For illustrative purposes an arrow 22*z* may be assumed to be fixed on the second external pad surface 22*b* of the circular plate 22. It similarly indicates a predetermined direction or orientation of this circular plate 22 with regard to the rotary sander 1. For instance, it may also be directed from the front side of the rotary sander 1 to the back side. In the embodiment of FIG. 15, the orientations 16*z*, 22*z* are maintained during the entire operation of the rotary sander 1. In other words, in all working positions (five of which are indicated in FIG. 8 by reference signs (1) to (5)) the arrows 16*z*, 22*z* are each parallel to a predetermined line which is oriented perpendicular to the rotary axis 12.

For illustrative purposes it may also be assumed that eight small sanding particles a to h are in the illustrated position (1) on the perimeter of the first and second external pad surfaces 16*a* and 22*b*. The particles a–d on the first external pad surface 16*a* are assumed to be separated from each other by 90° and similarly the particles e–h on the second external pad surface 22*b* are also assumed to be separated from each other by 90°. The particles a–h travel along small circles t of the same diameter passing through consecutive positions (1)–(5) thereby causing fine sanding of the work piece.

This is again shown in FIGS. 9–12 where the path of three particles k, l, m is shown when the radial collar 16 and circular plate 22 adopt four consecutive positions (1), (2), (3) and (4). In this case, the particles k, 1, m are situated on the first and second external pad surfaces 16*a* and 22*b* remote from the perimeter. Again, the particles k, l, m travel along small circles t having an equal diameter.

It must be stressed with regard to FIGS. 8 to 12 that in addition to the orbital motion around circles t, there is rotation of the radial collar 16 and circular plate 22 about their central axes 15 and 21 respectively caused by the relatively small internal friction generated by the bearings 13 and 19. These pad rotations (denoted by curved rotation arrows 33 and 34 respectively) cause coarse sanding of the work piece. The speed of these pad rotations is dependent on the load applied to the first and second external pad surfaces 16*b*, 22*a* respectively. If the rotary sander 1 operates with no load (eg if it is held in the air so that there is no friction between the first and second external pad surfaces 16*b*, 22*a* and the work piece), the radial collar 16 and the circular plate 22 start to rotate in the same direction as the rotary drive shaft 11 and each of the radial collar 16 and the circular plate 22 is accelerated until it reaches the same speed as the rotary drive shaft 11. If a load is applied (ie if the first and second external pad surfaces 16*b*, 22*a* are applied to the surface of the work piece), the radial collar 16 and the circular plate 22 decelerate. The pad rotations tend towards stopping and just a very low rotational speed may remain for coarse sanding. However the speed of orbital rotation (leading to elimination of vibration) and thus fine sanding is strongly related to the motor speed and not to the load applied so that orbital rotations will remain.

During use, friction between the radial collar 16 and the work piece on the one hand and the circular plate 22 and the work piece on the other hand is not always the same so that the pad rotations of radial collar 16 and circular plate 22 are not the same. This is unimportant for the anti-vibration performance because low pad rotations do not create vibrations.

Figure 13:
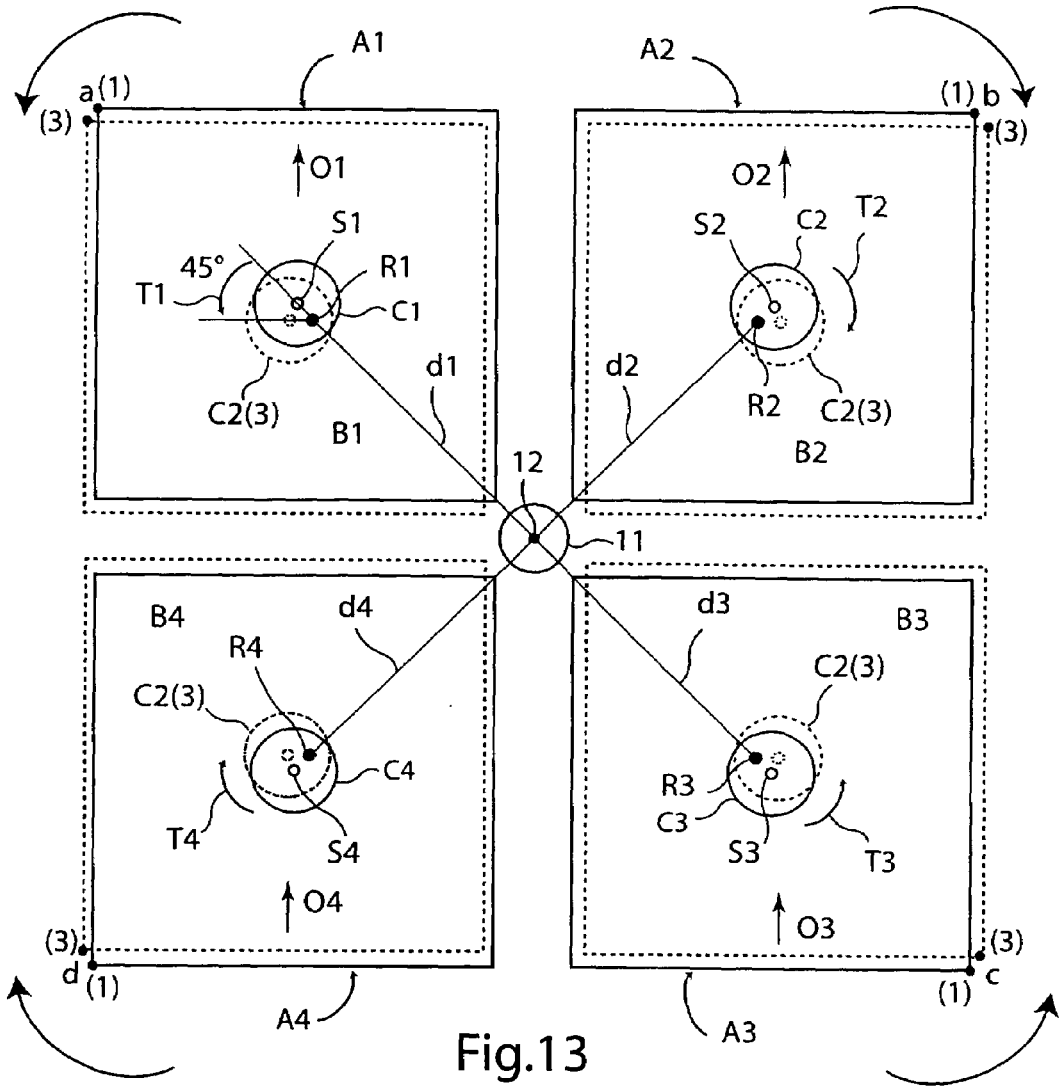
FIG. 13 is a bottom view of a second embodiment of the anti-vibration arrangement of the invention.

In FIG. 13, a second embodiment of the anti-vibration arrangement of the invention is illustrated. It works on the general principles of the first embodiment described hereinbefore. There are four pads A1, A2, A3, A4 arranged coplanarly in a symmetrical square configuration equidistant from the rotary axis 12 of the rotary drive shaft 11. The pads A1–A4 have a planar square shaped external pad surface B1–B4 with identical surface areas for attachment of equal-size sanding or polishing papers. For illustrative purposes, it is assumed that small sanding particles a, b, c, d are present at the outer corners. During operation, these sanding particles a–d adopt consecutive positions (1), (2), (3), (4) of which only positions (1) and (3) are illustrated. Position (3) results from a shift in the direction of the corner arrows by 45° with respect to position (1). The centres including central axes of external pad surfaces B1–B4 are denoted S1–S4. The external pad surfaces B1–B4 and circular areas C1–C4 in their centres S1–S4 are shown in solid lines in position (1) and in broken lines in position (3).

There are four orbital axes R1–R4 about which the centres S1–S4 and the central areas C1–C4 orbit consecutively between positions (1), (2), (3), (4). The orbital axes R1–R4 are at the same distance d1=d2=d3=d4 from the rotary axis 12. These distances d1–d4 remain unchanged during use. T1, T2, T3, T4 denote the direction of orbit. It will be appreciated that all neighboring external pad surfaces A1–A4 orbit in opposite directions with respect to each other whereby the individual orientation O1, O2, O3, O4 of the external pad surfaces B1, B2, B3, B4 remains unchanged. In this manner, vibrations are cancelled.

The second embodiment is driven by a drive shaft assembly and a gear assembly. The drive shaft assembly may be similar to that of FIG. 6 ie including two cams for neighboring pads A1, A3 and A2, A4, wherein each of the two drive shaft assemblies is connected to the rotary drive shaft 11. By such drive shaft assemblies and the gear assembly, the rotation of the rotary axis 12 is transferred to the four axes S1, S2, S3, S4 so that the external pad surfaces B1–B4 rotate in the directions T1–T4. The circles C1–C4 shown in solid line indicate the location of the associated cylindrical cam in the first position (1) whereas the circles shown in broken lines indicate the location of the associated cylindrical cam in the third position (3). In this embodiment, a significant reduction of vibrations is obtained. In addition to orbiting, the entire configururation will rotate arround the rotary axis 12, thereby performing pad rotations for coarse sanding.

FIG. 15 is a partial side view of a finishing sander 1 incorporating the first embodiment of the anti-vibration arrangement of the invention. The finishing sander 1 is essentially identical to the embodiment shown in FIG. 1 but additionally comprises a first connection piece 46 and a second connection piece 47. The first and second connection pieces 46, 47 are elongated and made of an elastic material such as rubber. The first connection piece 46 is fixed between the radial collar 16 and the housing 2 and the second connection piece 47 is fixed between the circular plate 22 and the annular lip 17*b* (ie indirectly between the second pad 23 and the housing 2). The first and second connection pieces 46, 47 ensure that the first and second pads 17 and 23 cannot rotate about their respective central axes 15 and 21. Since such rotations are prevented, the sanding papers 8 and 9 are restrained to orbit in small circles t as illustrated in FIGS. 8 to 12. In other words, the flexible connection pieces 46, 47 prevent the pad rotations whilst allowing orbital rotations.

Figure 16:
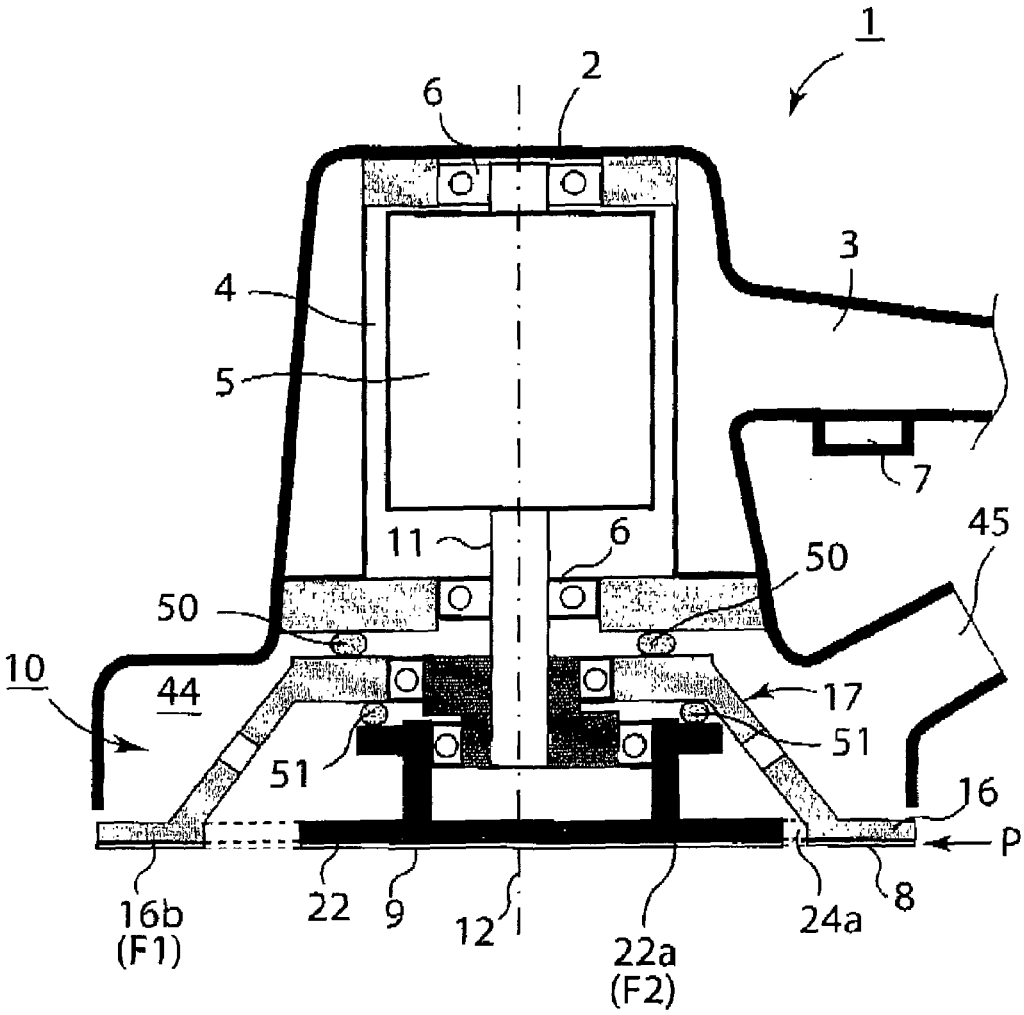
FIG. 16 is a partial side view of a second rotary sander incorporating the first embodiment of the anti-vibration arrangement of the invention.

In FIG. 16 there are illustrated two brakes 50, 51 used in a second rotary sander 1 otherwise identical to that of FIG. 1. The brakes 50, 51 slow down the rotation of the first and second pads 17 and 23 when there is no load applied to the rotary sander 1. The rotation speed is kept low because the brakes 50, 51 simulate a load. The brakes 50, 51 are illustrated schematically as rubber rings of different diameter.

We claim:

1. An anti-vibration arrangement for an eccentrically rotatable and oscillatory tool, the arrangement comprising:

a first pad having a first external pad surface for fitting a first abrasive element;

a second pad having a second external pad surface for fitting a second abrasive element, wherein the first external pad surface and the second external pad surface are substantially coplanar; and transmission means driveable by a rotary drive shaft of the motor for transmitting drive to the first pad and to the second pad to cause the first external pad surface and the second external pad surface to orbit out-of-phase about a first orbital axis and a second orbital axis respectively.

2. An arrangement as defined in claim 1 wherein the first orbital axis and the second orbital axis are common to the rotary axis of the rotary drive shaft.

3. An arrangement as defined in claim 1 wherein the first pad has essentially the same mass as the second pad.

4. An arrangement as defined in claim 1 wherein the first external pad surface has essentially the same area as the second external pad surface.

5. An arrangement as defined in claim 1 wherein the centre of gravity of the first pad and the centre of gravity of the second pad are aligned along a straight line intersecting the rotary axis.

6. An arrangement as defined in claim 1 wherein the second external pad surface is arranged substantially peripherally and eccentrically with regard to the first external pad surface.

7. An arrangement as defined in claim 1 wherein the second external pad is substantially circular.

8. An arrangement as defined in claim 6 wherein the first external pad surface is substantially annular.

9. An arrangement as defined in claim 1 wherein the first pad is substantially bell-shaped and comprises a conical main body terminating at an apical end in an annular lip and terminating at a non-apical end opposite to the apical end in a radial collar, the radial collar defining the first external pad surface.

10. An arrangement as defined in claim 1 wherein the second pad comprises a cylindrical main body capped by a circular plate defining the second external pad surface.

11. An arrangement as defined in claim 1 wherein the first pad further comprises at least one dust vent.

12. An arrangement as defined in claim 1 wherein the central axis of the first external pad surface and the central axis of the second external pad surface are arranged parallel to the rotary axis substantially in a common plane therewith.

13. An arrangement as defined in claim 12 wherein the central axis of the first external pad and the central axis of the second external pad are equidistant from the rotary axis.

14. An arrangement as defined in claim 1 wherein the transmission means comprises:

a monolithic drive shaft assembly mountable on the rotary drive shaft and having a first cam and a second cam for transmitting drive to the first external pad surface and the second external pad surface respectively.

15. An arrangement as defined in claim 14 wherein the first cam and the second cam are non-coaxial.

16. An arrangement as defined in claim 13 wherein the monolithic drive shaft assembly is provided with a central aperture for mounting on the rotary drive shaft, wherein the first cam and the second cam are substantially identical and are longitudinally and angularly displaced.

17. An arrangement as defined in claim 16 wherein the first cam and the second cam are angularly displaced by approximately 180°.

18. An arrangement as defined in claim 15 wherein the first cam and the second cam are each substantially cylindrical and wherein the eccentricity of the first cam and the second cam with respect to the rotary axis equals the orbital diameter.

19. An arrangement as defined in claim 7 wherein the outer diameter of the second external pad surface is slightly smaller than the inner diameter of the first external pad surface so that a minimum gap is maintained between the second external pad surface and the first external pad surface.

20. An arrangement as defined in claim 19 wherein the gap defines a passage for emitting debris from a work piece during use.

21. An arrangement as defined in claim 1 wherein the transmission means comprises:

a first bearing mounted on or in the first pad; and a second bearing mounted on or in the second pad.

22. An arrangement as defined in claim 21 wherein the first bearing is mounted on the first cam and the second bearing is mounted on the second cam.

23. An arrangement as defined in claim 1 wherein the first external pad surface and the second external pad surface are substantially rectangular or square.

24. An arrangement as defined in claim 1 comprising four pads with external pad surfaces having individual orbital axes and wherein neighboring pads are adapted to orbit in opposite directions.

25. An arrangement as defined in claim 24 wherein the four pads are disposed in a square configuration.

26. An arrangement as defined in claim 1 wherein the first external pad surface has a first predetermined orientation and the second external pad surface has a second predetermined orientation, wherein the transmission means is adapted to transmit drive to the first external pad surface and the second external pad surface in a manner such that the first and second predetermined orientations are maintained.

27. An eccentrically rotatable and oscillatory tool comprising:

a housing;

a handle mounted on or integral with the housing;

an electric motor supported in the housing, wherein the electric motor has a rotary drive shaft with a longitudinal rotary axis; and transmission means driveable by a rotary drive shaft of the motor for transmitting drive to a first pad and to a second pad to cause a first external pad surface of the first pad and a second external pad surface of the second pad to orbit out-of-phase about a first orbital axis and a second orbital axis respectively.

28. A tool as defined in claim 27 wherein the first and second pad surfaces are coplanar and fitted with abrasive elements.

29. A tool as defined in claim 27 further comprising:

a counterweight associated with the rotary drive shaft, wherein the centre of gravity of the counterweight is located outside the rotary axis.

30. A tool as defined in claim 27 further comprising:

a cooling fan mounted radially on the rotary drive shaft; and a counterweight disposed on the cooling fan, wherein the centre of gravity of the counterweight and the cooling fan is located outside the rotary axis.

31. A tool as defined in claim 27 further comprising:

an air and dust vent connected to or integral with the housing for connecting a fan.

32. A tool as defined in claim 27 further comprising:

a first resilient connection piece fixed between the first pad and the housing and a second resilient connection piece fixed between the second pad and the housing.

33. A tool as defined in claim 27 further comprising:

at least one brake for reducing the rotational speed of at least one of the first and second pads at least when no load is applied to at least one of the first and second pads.

* * * * *